United States Patent [19]

Swanson

[11] 4,000,522

[45] Jan. 4, 1977

[54] SHIRT COLLAR STRAP

[76] Inventor: Arthur P. Swanson, 1454 Estate Lane, Glenview, Ill. 60025

[22] Filed: Feb. 25, 1976

[21] Appl. No.: 661,357

[52] U.S. Cl. ..... 2/141 R; 2/116

[51] Int. Cl.[2] ..... A41B 3/02

[58] Field of Search ..... 2/141 R, 141 A, 131, 2/116, 115, 128

[56] References Cited

UNITED STATES PATENTS

| | | | |
|---|---|---|---|
| 928,017 | 7/1909 | Adler | 2/141 A |
| 1,251,069 | 12/1917 | Mc Kay | 2/141 R |
| R13,104 | 4/1910 | Koppelman | 2/141 A |

*Primary Examiner*—G. V. Larkin

*Attorney, Agent, or Firm*—Hill, Gross, Simpson, Van Santen, Steadman, Chiara & Simpson

[57] ABSTRACT

A front-opening shirt with attached, turn-down collar is adapted for wearing either closed-collar style as with a necktie, or in a casual, open-collar style in which no button, button hole, or other fastener is visible on the free ends of the neck band, thereby improving the appearance of the shirt for such casual wear. The collar is closed by means of a strap or tab which is mounted swivelably at one of its ends on a stud or button on the neck band hidden beneath the turned-down collar adjacent the shirt front, and connected by its other end to a similarly-hidden second button adjacent the other end of the neck band. The strap holds the overlapping ends of the neck band together and a necktie may be placed thereabout and tied at the front in a conventional manner. When the shirt is to be worn casually, the free other end of the tab is detached from the second button, swivelled about the first stud or button, and secured to a third button on the neck band beneath the collar inboard from the first stud or button.

6 Claims, 5 Drawing Figures

SHIRT COLLAR STRAP

BACKGROUND OF THE INVENTION

1. Field of the Invention

The present invention relates to devices for selective closure of a collar-equipped garment and particularly to hidden shirt collar closure devices.

2. The Prior Art

Prior attempts to provide shirts having attached collars for closed-collar formal or open-collar sports wear have required fasteners which leave exposed buttons, button holes, tabs, or the like which cannot be hidden or which produce bulky appearances in the open-collar position. U.S. Pat. No. 2,713,684 discloses a rigid tab receivable in pockets on either side of the neck band to provide a nonapparent closing means. U.S. Pat. No. 2,740,124 shows a retractable button attached to the neck band of a shirt. U.S. Pat. No. 2,756,432 shows a retractable loop which engages a button hidden beneath a collar. U.S. Pat. No. 2,502,921 discloses a sport shirt or jacket adapted to be worn in an open-collar style or in closed-collar style with a scarf threaded over a tab which is extended across the front opening of the shirt from a stitched connection to a neck band beneath one collar to a button on the neck band beneath the other collar. The tab disclosed is designed to be folded back under the collar when the shirt is to be worn open.

SUMMARY OF THE INVENTION

The present invention now provides a collar fastener which is completely hidden in an open-collar position without creating any collar bulge or wrinkle.

DESCRIPTION OF THE PREFERRED EMBODIMENTS

Figure 1:
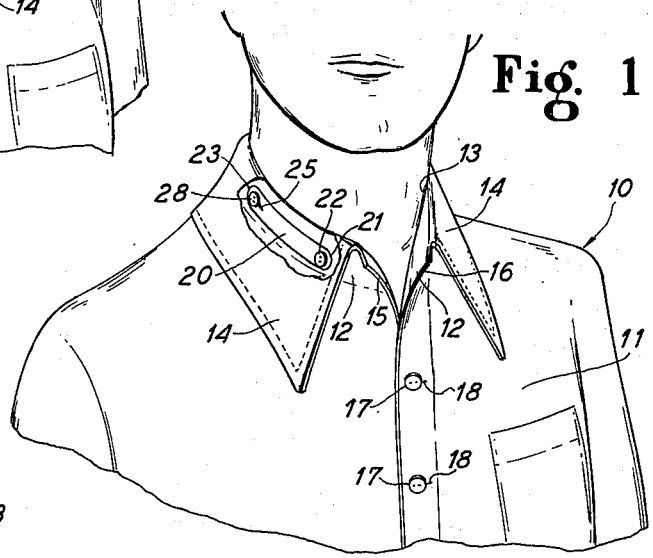
FIG. 1 is a perspective view of the upper part of a shirt worn in an open-collar position with portions broken away to show underlying structure.

A man's shirt 10 constructed in accordance with the principles of the present invention is shown in FIG. 1 being worn in an open-collar style. The body 11 of the shirt 10 has an upstanding discrete neck band 12 attached thereto about a neck opening 13. Attached to an upper end of the neck band 12 is a collar 14 which is turned down to overlie the neck band 12 and a portion of the body 11 of the shirt 10. Generally the neck band 12 and the collar 14 will be of material identical to the body 11 of the shirt 10, although these parts will typically be of multiple-layer construction to give added stiffness thereto.

In accordance with the principles of the present invention, the discrete upstanding neck band 12 has no button or button hole formed in either the right end 15 (from the wearer's viewpoint) or the left end 16 thereof. In conventional shirts, a collar button would be provided in the right end of the neck band 12 at 15 in alignment with front buttons 17 employed to close the front of the shirt. A button hole would in a conventional shirt be provided at the neck band in a corresponding position aligned with button holes 18 in the left side of the shirt.

Figure 2:
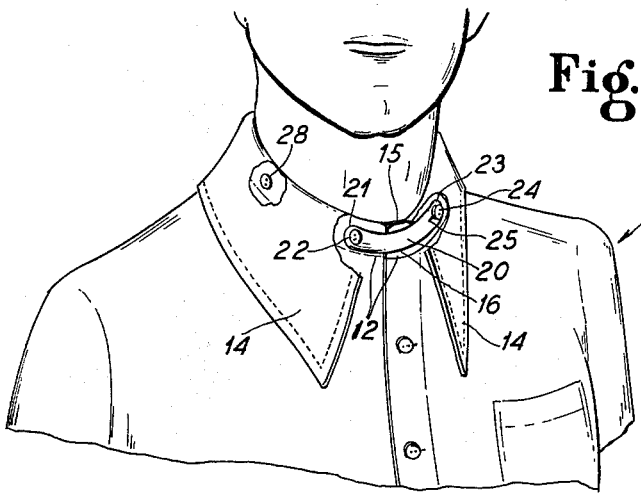
FIG. 2 is a perspective view similar to FIG. 1 but showing the shirt with a closed collar and also with portions broken away to show underlying structure.

In contrast, in accordance with the principles of the present invention, free ends 15 and 16 of the neck band 12 of the shirt 10 are not marred by the presence of a button or button hole and may be worn freely in the open-collar position shown in FIG. 1. When it is desired to wear the shirt 10 in a closed-collar style, as shown in FIG. 2, the right and left ends 15 and 16 of the neck band 12 are overlapped and held in closed position by an elongated strap or tab 20.

The elongated tab or strap 20 is preferably reinforced by stitching together several layers of shirt fabric material providing a firmness or stiffness to hold its shape at least along the major portion of its length. At least the front face of the tab or strap should be composed of fabric of the same color and pattern as the shirt material. However it is preferred that the ends of the tab remain relatively soft or limp to facilitate receiving a button as hereinafter described. The tab 20 is swivelably mounted at a first end 21 thereof to the neck band 12 adjacent the right end 15 thereof, beneath the down-turned collar 14. Such mounting is conveniently accomplished in one embodiment by a first fastener such as a button 22 sewn to the neck band 12, the thread passing through an aperture in the strap 20 and engaging the material of the neck band 12. The button 22 will overlie the strap 20 at its first end 21.

The strap 20 is affixed releasably at a second end 23 thereof for closed-collar wearing by a second fastener such as a button 24. The button 24 is affixed to the neck band 12 spaced from the end 16 thereof and beneath the collar 14. The strap 20 has a button hole 25 in this second end 23 for releasably grasping the button or other fastening means 24. When the strap or tab 20 is in its closed-collar position, it will lie flat against the neck band 12, overlapping the ends 15 and 16 thereof without any lumps or bulges.

The strap 20 is preferably made from the same material as the neck band 12 or the collar 14 so that it will be inconspicuous beneath a necktie 26. The tie 26 is passed about the neck opening 13 of the shirt 10 between the collar 14 and the neck band 12 and over the strap 20, where it is formed into a knot 27 at the front of the shirt between the front edges of the collar 14, as shown in FIG. 3.

Figure 3:
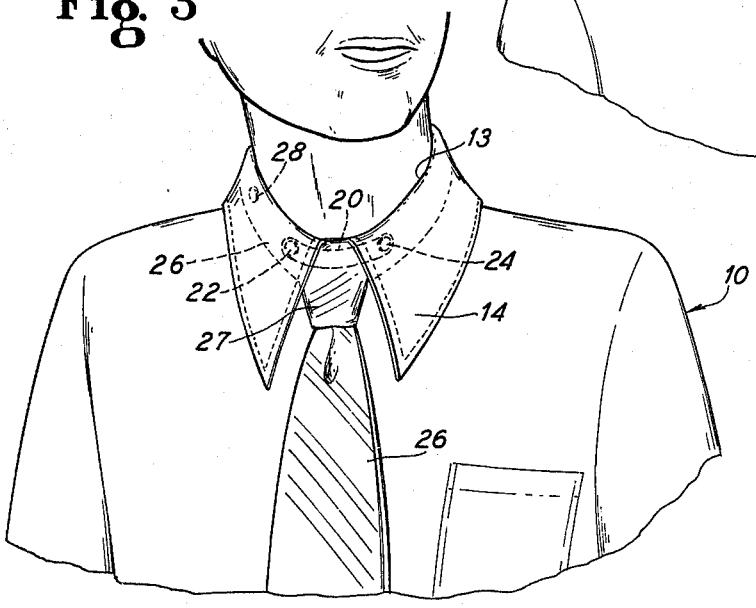
FIG. 3 is a perspective view similar to FIG. 2 showing another view of the shirt worn in closed-collar style and with a necktie.

To convert the shirt 10 from the closed-collar style of FIGS. 2 and 3 to the open-collar style of FIG. 1, the strap 20 is detached from the second button 24 under the left side of the collar 14 and is swivelled about the attachment stud or button 22 to underlie the right side of the collar 14, opposite the fastener 22 from the right end 15 of the neck band 12, as shown in FIG. 1.

In this concealed position, the free or second end 23 of the strap 20 is engaged with a third fastener such as a button 28 which, like the second button 24, is threaded to the neck band 12. The aperture or button hole 25 in the free end 23 of the strap 20 is engaged beneath the third button 28, thereby securing the strap 20 in a flat position and entirely hidden under the collar 14.

Thus, the shirt 10 is fully and easily convertible between a casual wearing style wherein the neck opening is clean and free of holes and hardware, and a more formal, closed-collar style in which the collar is securely closed for receiving a necktie.

Figure 4:
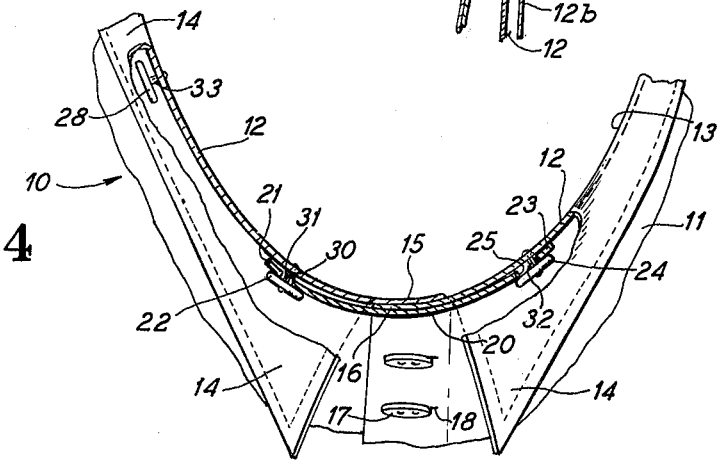
FIG. 4 is a fragmentary top view, partially horizontal in section, of a shirt and tab of the present invention.

FIG. 4 shows in detail some of the constructional features of the shirt collar strap of the present invention, in which the shirt 10 is in its closed-collar position. In FIG. 4 it is shown that the elongated tab or strap 20 is free to swivel about its first end 21, or, more precisely about an aperture 30 therein which engages a length of thread 31 or similar means employed to attach the button 22 to the neck band 12 at this first point. The aperture 30 may be formed as a conventional button hole — a slit surrounded by a closely worked loop stitch. The slit may be longer than the button 22 is wide, to make the strap 20 removable from the button 22, or the aperture 30 may be a small circular hole reinforced by stitching or by a metal grommet through which the thread 31 is passed.

The second or free end 23 of the strap 20 is shown in FIG. 4 to be releasably engaged by a second button 24 which is tied to the neck band 12 at a second point, as by a thread 32. The aperture 25 formed in the strap 20 inwardly from the second end 23 thereof is conveniently formed as a conventional button hole so that the tab 20 is removably engageable with the button 24. The button 24 is spaced about the neck band 12 from the point of attachment of the first button 22 by a distance sufficient to cause a flat overlap between the ends 15 and 16 of the neck band 12 and to hold the collar 14 in a proper position with respect to the body of the shirt 11 when a necktie is worn, as in FIG. 3.

The third button 28 is shown in FIG. 4 to be affixed to the neck band 12 by a thread 33 at a point spaced about the neck band 12 opposite the end 15 from the first point, where the first mounting stud or button 22 is attached. The third button 28 is spaced from the first button 22 by a distance equal to that between the first button 22 and the second button 24 when the collar is in its closed position. Such spacing lays the strap 20 flat against the neck band 12 and beneath the collar 14 for wearing the shirt in the open-collar style of FIG. 1. In one embodiment of the invention, the tab 20 is ⅜ to ½ inch wide and about 2½ inches long, necessitating a spacing of 2 to 2¼ inches between each of the pairs of buttons 22–28 and 22–24.

Figure 5:
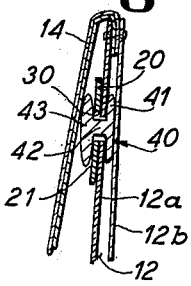
FIG. 5 is a transverse, sectional view through a stud swivel mounting for the tab of the present invention.

FIG. 5 shows an alternate embodiment of the attachment means between the first end 21 of the tab 20 and the neck band 12 of the shirt 10. In this embodiment, rather than a button 22 tied to the neck band 12 by a thread 31 as shown in FIG. 4, a metal or plastic stud 40 is employed. The stud 40 has an inner head 41 which is captured between dual plys **12*a* and 12*b* of the neck band 12. A shank 42 of the stud 40 passes through an aperture in the outer neck band layer 12*a* which may be reinforced by stitching, and through the aperture 30 in the first end 21 of the elongated strap 20. A second enlarged head 43 of the stud 40 overlies the material of the end 21 of the collar 20 to restrain the strap 20 from loss while allowing it freely to rotate about the shank 42. The collar 14 of the shirt 10 overlies the strap 20 and stud 40 as in the embodiment of FIGS. 1–4. For ease of assembly, the stud 40 may be made in two pieces, which are permanently joined after assembly along the shank 42 or between the shank 42 and the outer head 43**.

Although various minor modifications might be suggested by those versed in the art, it should be understood that I wish to embody within the scope of the patent warranted hereon all such modifications as reasonably and properly come within the scope of my contribution to the art.

I claim as my invention:

1. A front-button shirt having a discrete upstanding neck band with an attached, turned-down collar on the top end of the neck band adapted to be worn in a closed-collar position with a necktie and in an open-collar position without exposing a button, a fastening attachment for the button, or a buttonhole at the neck band, said neck band being free from a button and buttonhole at its ends, an elongated tab having a first end rotatably mounted on the neck band near but spaced sufficiently from one end of the neck band to be covered by the collar, said tab having a buttonhole in a second opposite end thereof, a first button on the same end of the neck band spaced from the rotatably mounted end of the tab a sufficient distance to be seated in the buttonhole of the tab to hold the tab flat against the neck band under the collar to be completely hidden in the open-collar position, and a second button on the opposite end of the neck band but spaced from said end to be covered by said collar, whereby said tab is adapted to be unbuttoned from said first button, rotated to extend over the opposite end of the neck band and receive the second button in the buttonhole thereof to hold the ends of the neck band in overlapped, closed-collar position.

2. The shirt of claim 1 wherein the neck band is composed of a plurality of layers of fabric material providing stiffness to hold the band in upright position.

3. The shirt of claim 2 wherein the first attachment means is a two-headed stud with a first head between the layers of the neck band and a second head overlying the tab and said stud having a shank portion extending through the neck band and through the tab swivelably mounted on the neck band.

4. A collar-closure arrangement for a front-buttoned shirt having a discrete upstanding neck band with an attached turned-down collar secured to the upper end of the neck band, said collar and said neck band extending about the shirt from one side of said front to the other side of said front, said shirt being wearable selectively in closed-collar and open-collar styles with the closure arrangement mounted on the neck band and completely hidden by the turned-down collar in the open-collar position, said collar-closure arrangement comprising an elongated tab having an aperture through each end thereof, said apertures being spaced apart by a predetermined length, a first attachment means on said neck band at a first point spaced from one of the ends of the neck band under the collar and swivelably engaging a first end of said tab, a second attachment means mounted on said neck band under said collar at a second point spaced around the neck band from said first point a distance equivalent to said length between tab apertures, and a third attachment means on the neck band covered the collar and positioned at a third point spaced from the other end of the neck band for selectively receiving the aperture of the tab after it is released from the second attachment means to hold the ends of the neck band in overlapped, closed position.

5. In a shirt having overlapping, front opening portions, a discrete upstanding neck band at the top of the shirt and extending from one end about a neck opening to a second end, a collar attached to the upper end of said neck band and adapted to be turned down over said neck band and worn selectively in a closed position as with a necktie or in an open position without exposure of a button or buttonhole which comprises an elongated tab having a first end rotatably mounted on said neck band near but spaced sufficiently from one end of the neck band to be covered by the turned-down collar, said tab having a free end, a first fastener on the neck band engageable with the free end of the tab to hold the tab under the collar, and a second fastener on the opposite end of the neck band but spaced beneath the collar to selectively receive the free end of the tab and to hold the tab for closing the neck band with the ends of the neck band in overlapped position.

6. The shirt of claim 5 wherein the rotatable mounting and the first and second attachment means for the tab are buttons and the tab has buttonholes releasably receiving said buttons whereby said tab is removable from said shirt.

* * * * *